US008205971B2

(12) United States Patent
Newton et al.

(10) Patent No.: US 8,205,971 B2
(45) Date of Patent: Jun. 26, 2012

(54) ELECTRICALLY GROUNDED INKJET EJECTOR AND METHOD FOR MAKING AN ELECTRICALLY GROUNDED INKJET EJECTOR

(75) Inventors: Tygh J. Newton, Sherwood, OR (US); John R. Andrews, Fairport, NY (US); David L. Knierim, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 333 days.

(21) Appl. No.: 12/689,320

(22) Filed: Jan. 19, 2010

(65) Prior Publication Data

US 2011/0175971 A1 Jul. 21, 2011

(51) Int. Cl.
*B41J 2/045* (2006.01)

(52) U.S. Cl. ..... 347/71

(58) Field of Classification Search ..... 347/50, 347/57–59

See application file for complete search history.

(56) References Cited

U.S. PATENT DOCUMENTS 5,716,663 A 2/1998 Capote et al.
5,744,285 A 4/1998 Felten et al.
6,003,974 A 12/1999 Wilson et al.
6,322,206 B1 11/2001 Boyd et al.
6,435,653 B1 8/2002 Boyd et al.
6,592,943 B2 7/2003 Chan et al.
7,347,533 B2 3/2008 Elrod et al.
7,575,302 B2 8/2009 Massopust et al.
2002/0066179 A1 6/2002 Hall et al.
2004/0126547 A1 7/2004 Coomer
2011/0141204 A1* 6/2011 Dolan et al. ..... 347/71
2011/0141205 A1* 6/2011 Gerner et al. ..... 347/71

* cited by examiner

*Primary Examiner* — Matthew Luu
*Assistant Examiner* — Lisa M Solomon
(74) *Attorney, Agent, or Firm* — Maginot, Moore & Beck, LLP

(57) ABSTRACT

An inkjet ejector provides electrical conductors for grounding electrically isolated layers in the ejector while electrically coupling a transducer of the ejector to a firing signal circuit. The inkjet ejector includes a diaphragm plate have a first side and a second side, a plurality of transducers mounted to the first side of the diaphragm plate, a polymer layer located on the second side of the diaphragm plate, an electrically conductive layer that is isolated from electrical ground by the polymer layer, and a plurality of electrical conductors, at least one of the electrical conductors extends from the electrically conductive layer to electrical ground through the polymer layer and other electrical conductors of the plurality of electrical conductors extend from each transducer to a firing signal circuit, the electrical conductor extending from the electrically conductive layer being the same material as the other electrical conductors in the plurality of electrical conductors.

8 Claims, 4 Drawing Sheets

ELECTRICALLY GROUNDED INKJET EJECTOR AND METHOD FOR MAKING AN ELECTRICALLY GROUNDED INKJET EJECTOR

TECHNICAL FIELD

This disclosure relates generally to inkjet ejectors, and, in particular, to inkjet stacks used to form inkjet ejectors for print heads used in inkjet imaging devices.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper.

FIGS. 4A and 4B illustrate one example of a single inkjet ejector 10 that is suitable for use in an inkjet array of a print head. The inkjet ejector 10 has a body 22 that is coupled to an ink manifold 12 through which ink is delivered to multiple inkjet bodies. The body also includes an ink drop-forming orifice or nozzle 14 through which ink is ejected. In general, the inkjet print head includes an array of closely spaced inkjet ejectors 10 that eject drops of ink onto an image receiving member (not shown), such as a sheet of paper or an intermediate member.

Ink flows from the manifold to nozzle in a continuous path. Ink leaves the manifold 12 and travels through a port 16, an inlet 18, and a pressure chamber opening 20 into the body 22, which is sometimes called an ink pressure chamber. Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

Ejection of an ink droplet is commenced with a firing signal. The firing signal is applied across metal film layers 34 to excite the piezoelectric transducer 32, which causes the transducer to bend. Because the transducer is rigidly secured to the diaphragm 30, the diaphragm 30 deforms to urge ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

To facilitate manufacture of an inkjet array print head, inkjet ejector 10 can be formed of multiple laminated plates or sheets. These sheets are stacked in a superimposed relationship. Referring once again to FIGS. 4A and 4B, these sheets or plates include a diaphragm plate 40, an inkjet body plate 42, an inlet plate 46, an aperture brace plate 54, and an aperture plate 56. The piezoelectric-transducer 32 is bonded to diaphragm 30, which is a region of the diaphragm plate 40 that overlies ink pressure chamber 22. In previously known inkjet ejectors, these plates are metal plates that are brazed to one another with gold.

In some newly developed inkjet ejectors, one or more of the layers may be a polymer layer. Polymers are generally non-conductive electrically. Consequently, metal plates electrically isolated by polymer layers from electrical ground may develop an electrical potential that is different than another portion of the inkjet ejector. The electrical potential difference may cause the ink flowing through the inkjet ejector to conduct a current. In some inkjet ejectors, electrical current flow in the ink may cause ink to drool or otherwise be emitted from an aperture without a firing signal being applied to the transducer for the ejector. Neutralizing electrical potential differences in an inkjet ejector would help address issues that may arise from electrical currents in an ejector.

SUMMARY

An inkjet ejector provides electrical conductors for grounding electrically isolated layers in the ejector while electrically coupling a transducer of the ejector to a firing signal circuit. The inkjet ejector includes a diaphragm plate have a first side and a second side, a plurality of transducers mounted to the first side of the diaphragm plate, a polymer layer located on the second side of the diaphragm plate, an electrically conductive layer that is isolated from electrical ground by the polymer layer, and a plurality of electrical conductors, at least one of the electrical conductors extends from the electrically conductive layer to electrical ground through the polymer layer and other electrical conductors of the plurality of electrical conductors extend from each transducer to a firing signal circuit, the electrical conductor extending from the electrically conductive layer being the same material as the other electrical conductors in the plurality of electrical conductors.

The inkjet ejector may be made in a manner that electrically grounds the electrically isolated layers without adding more operations to the manufacturing process. The method includes bonding a plurality of transducers to a first side of a diaphragm plate, bonding a plurality of layers to a second side of the diaphragm plate, at least one of the layers in the plurality of layers being a polymer layer that electrically isolates an electrically conductive layer in the plurality of layers from electrical ground, exposing a portion of the electrically conductive layer isolated from electrical ground by the polymer layer, applying an electrically conductive material to each transducer and to the exposed portion of the electrically conductive layer in a single operation, and coupling the electrically conductive material applied to each transducer to a firing signal circuit and coupling the electrically conductive material applied to the exposed portion of the electrically conductive layer to an electrical grounding plane. Because current manufacturing techniques couple the transducers to the firing circuit, this process that couples the electrically isolated layers to electrical ground as the transducers are coupled to the firing circuit enhances the electrical integrity of the inkjet ejector without adding other manufacturing operations.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
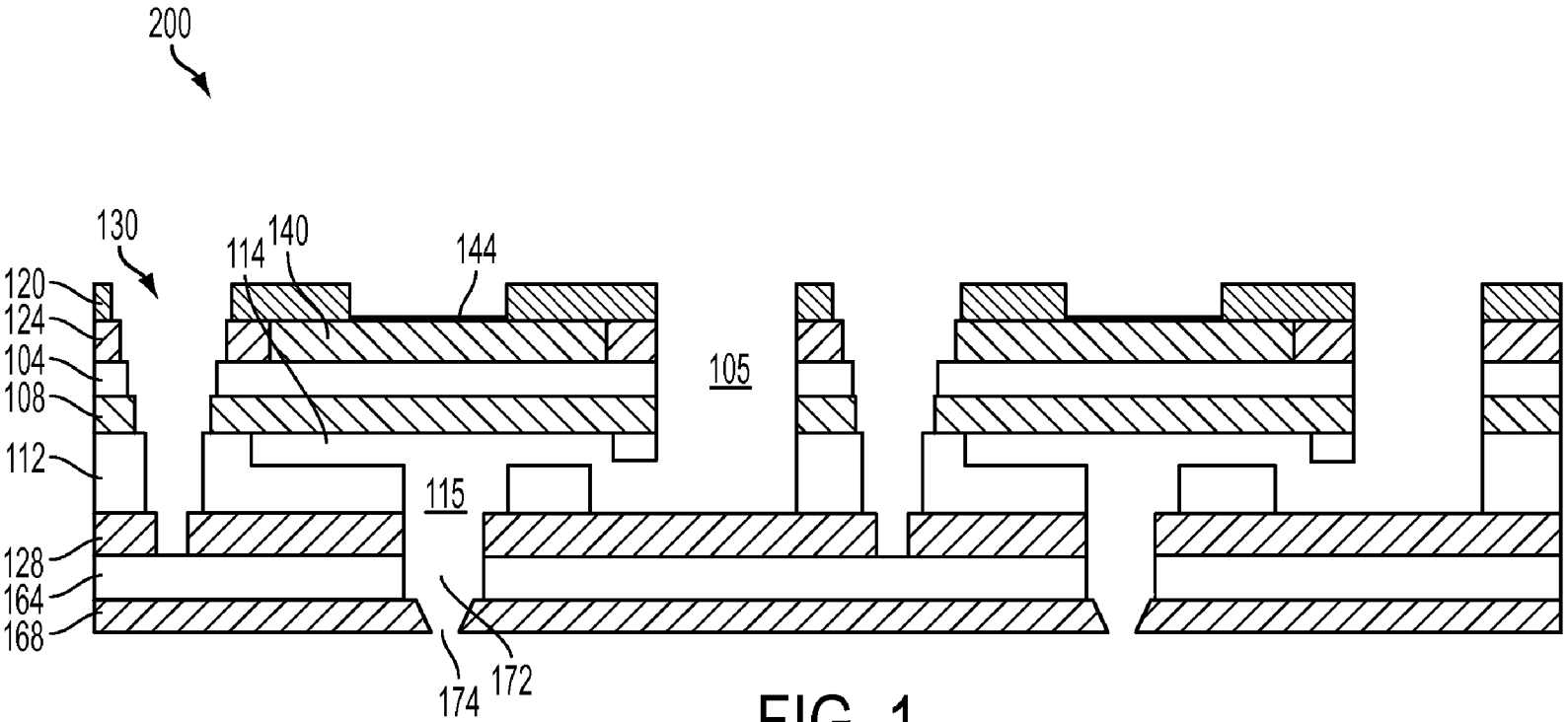
FIG. 1 is a cross sectional view of another partial inkjet print head in which multiple electrically conductive layers, separated by electrically insulative layers, have surfaces exposed by aligning gaps formed through each layer.

For a general understanding of the present embodiments, reference is made to the drawings. In the drawings, like reference numerals have been used throughout to designate like elements. As used herein, the term "imaging device" generally refers to a device for applying an image to print media. "Print media" can be a physical sheet of paper, plastic, or other suitable physical print media substrate for images. The print media may be supplied in either sheet form or as a continuously moving web. The imaging device may include a variety of other components, such as finishers, paper feeders, and the like, and may be embodied as a copier, printer, or a multifunction machine. The word "polymer" encompasses any one of a broad range of carbon-based compounds formed from long-chain molecules including thermoset polyimides, thermoplastics, resins, polycarbonates, and related compounds known to the art. As used herein, a polymer is an electrical insulator. The word "metal" may encompass either single metallic elements including, but not limited to, copper, aluminum, or titanium, or metallic alloys including, but not limited to, stainless steel or aluminum-manganese alloys. As used herein, a metal is an electrical conductor. A "transducer" as used herein is a component that reacts to an electrical signal by generating a moving force that acts on an adjacent surface or substance. The moving force may push against or retract the adjacent surface or substance.

FIG. 1 depicts a cross-sectional view of a partial inkjet print head 200 in which multiple electrically conductive layers are separated by electrically insulative layers. The print head is assembled by bonding a series of inkjet ejector layers together. As shown in FIG. 1, multiple transducers 140 are bonded to a diaphragm layer 104. The diaphragm layer is a thin, electrically conductive metal layer having a plurality of ink ports 105 and one or more openings etched through the layer. The openings are used to form a pass-through via 130 as described more fully below. Each transducer has a single electrode 140 that allows an electrical current to be applied to the transducer. As discussed below, the metal diaphragm layer 104 is electrically coupled to electrical ground to complete an electrical path for the flow of electrical current through the transducer. Some forms of transducer include thermal transducers that increase in temperature rapidly under an applied electric current, while other forms include piezoelectric transducers that bend under an applied electric current.

Continuing to refer to FIG. 1, an optional thermoplastic polyimide sheet 108 is bonded to the side of the diaphragm opposite the transducers. While many types of polyimide may be used, DuPont ELJ-100® is one example of a suitable material. In some embodiments, polymer layer 108 provides rigidity, but is flexible enough to bend with the diaphragm in response to the deformation of the transducer under the effect of an electric current. Other embodiments may omit polymer layer 108. The body layer 112 is bonded to the side of the polymer layer 108 not adjacent to the diaphragm. The body layer is a metal plate that may be composed of two or more metal plates that have been brazed together, often using gold brazing techniques. The body layer has several channels and cavities, typically known as pressure chambers, etched through the layer that enable ink to flow through the print head. The pressure chamber 114 is situated below the diaphragm layer 104 and the polymer layer 108 and this chamber holds ink prior to the ink being ejected from the print head. Ink flows through the outlet port 115 to outlet channel 172 and is ejected through the nozzle 174. The body layer 112 also includes one or more openings etched through the layer that are aligned with the openings in the diaphragm layer to form the pass-through via 130.

An outlet plate polymer layer 128 is bonded to the base of the body layer 112. This polymer layer may be composed of the same polyimide of layer 108, or another suitable polymer material. The aperture brace plate 164 is then bonded to the side of the polymer layer 128 that is not adjacent to body layer 112. The outlet plate 128 and aperture brace plate 164 enable ink to exit the print head as a droplet. The aperture brace plate 164 is a metal layer that has multiple outlet channels 172 etched through the plate, each outlet channel is aligned with an outlet port in the outlet plate to couple a pressure chamber in the body layer fluidly to an aperture 174 in the aperture layer 168. The aperture layer 168 is bonded to the aperture brace plate 164 and contains apertures or nozzles 174 that are aligned with an outlet port. The aperture layer may be made either from a metal sheet that is brazed to the aperture brace plate, or from a polymer layer that is bonded to the aperture brace plate.

Returning to the transducers of FIG. 1, an interstitial polymer layer 124 may be placed around the transducers to fill gaps between the transducers. In some embodiments, the interstitial polymer layer may be applied as a liquid that is later cured into a solid form. One or more openings are provided in the interstitial polymer layer to align with the openings in the other layers to help form the pass-through via 130. A standoff layer 120 is bonded to the upper surface of the interstitial polymer layer. The stand off layer is also composed of a polymer, and has gaps that allow the transducer electrodes to remain exposed. The gaps also give the transducer room to deform, which is important for correct operation of an inkjet ejector since thermal transducers may expand and contract, and piezoelectric transducers may bend while in operation.

In the embodiment of FIG. 1, the openings are aligned to form a pass-through via 130 in the standoff layer 120, the optional interstitial layer 124, the diaphragm layer 104, the polymer layer 108, the body layer 112, and outlet plate polymer layer 128. The openings are formed during the production of each of the aforementioned layers prior to the layers being assembled into the partial inkjet stack 200. In FIG. 1, the outer boundaries of pass-through via 130 form a roughly conical shape, with the widest gap formed through standoff layer 120 tapering to the narrowest gap through outlet plate polymer layer 128 to expose aperture brace plate 160. The wider opening through standoff layer 120 promotes the application of a conductive adhesive material as shown in FIG. 2.

Figure 2:
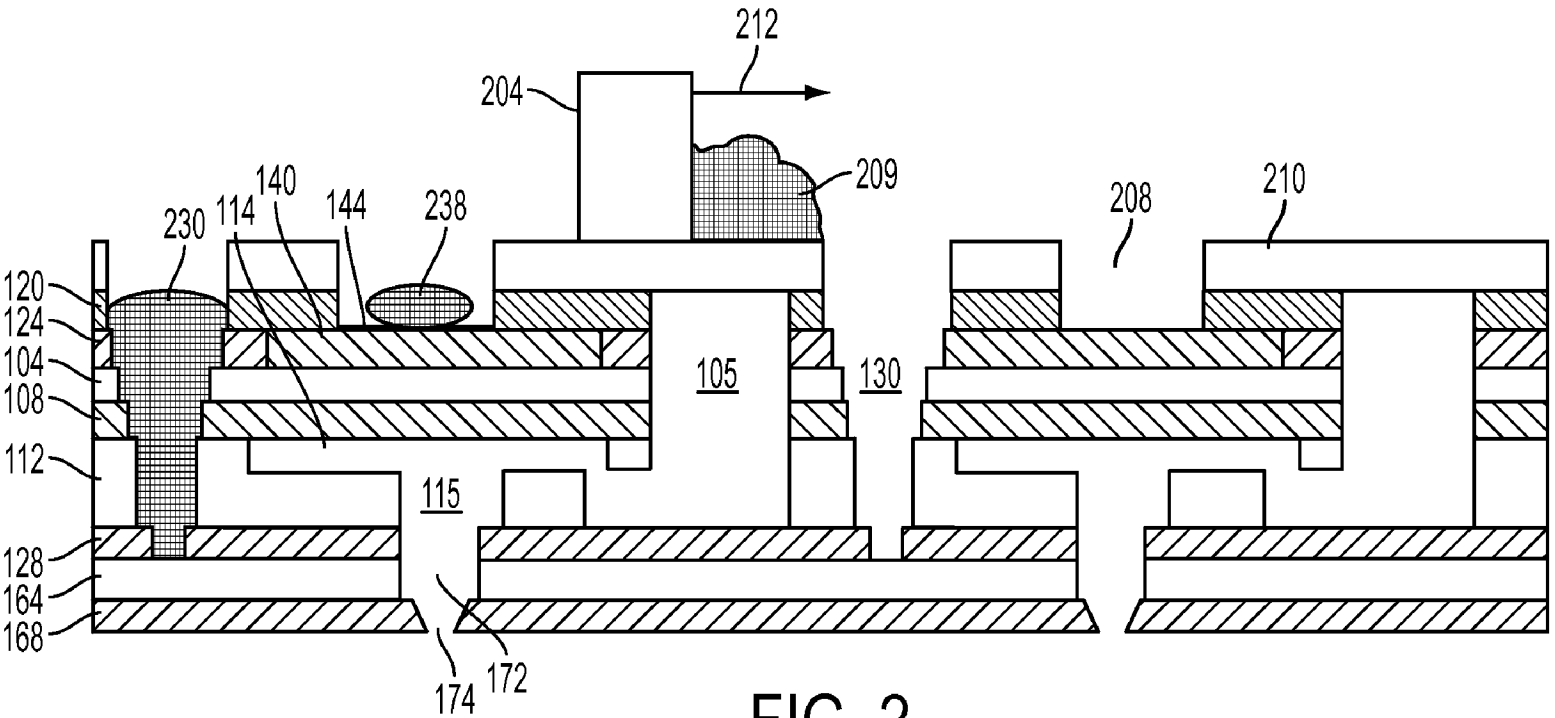
FIG. 2 is a cross sectional view of the partial inkjet print head of FIG. 1 undergoing a stenciling operation.

FIG. 2 depicts the print head of FIG. 1 undergoing a stenciling operation. First, a stencil mask 210 is placed over the standoff layer 120. The stencil has gaps 208 in portions where an electrically conductive adhesive is intended to flow. In the other areas of the mask 210 the flow of electrically conductive adhesive is blocked. A stenciling blade 204 passes over the print head's surface in direction 212, pushing a free mass of electrically conductive adhesive 209 before it. When the stenciling blade 204 passes over the channel 130, which exposes portions of each electrically conductive layer, a portion of the free electrically conductive adhesive is deposited into the channel to form a mass 230 that contacts the exposed portions of the aperture brace plate 164, body layer 112, and diaphragm layer 104. In the same sweep, the stenciling blade also deposits portions of the free electrically conductive adhesive mass to form an electrically conductive mass 238 on electrode 144. Thus, the channels formed in the layers enable an electrical conductor to be formed that couples the lower metal layers to the diaphragm layer 104 in the same operation that forms the electrical connections to the transducer 140. Additionally, the electrically conductive adhesive material is ideally a flexible metallic suspension, and a silver-filled epoxy is an example of an adhesive having the desired characteristics. This material is the same material used to couple the transducers to the firing circuits. Thus, the metal layers of the inkjet ejector stack are electrically coupled to the diaphragm layer at the same time that the transducer connections are formed with the same conductive material. After the stenciling blade has completed the pass across the print head's surface, the stencil mask is removed from the print head.

Figure 3:
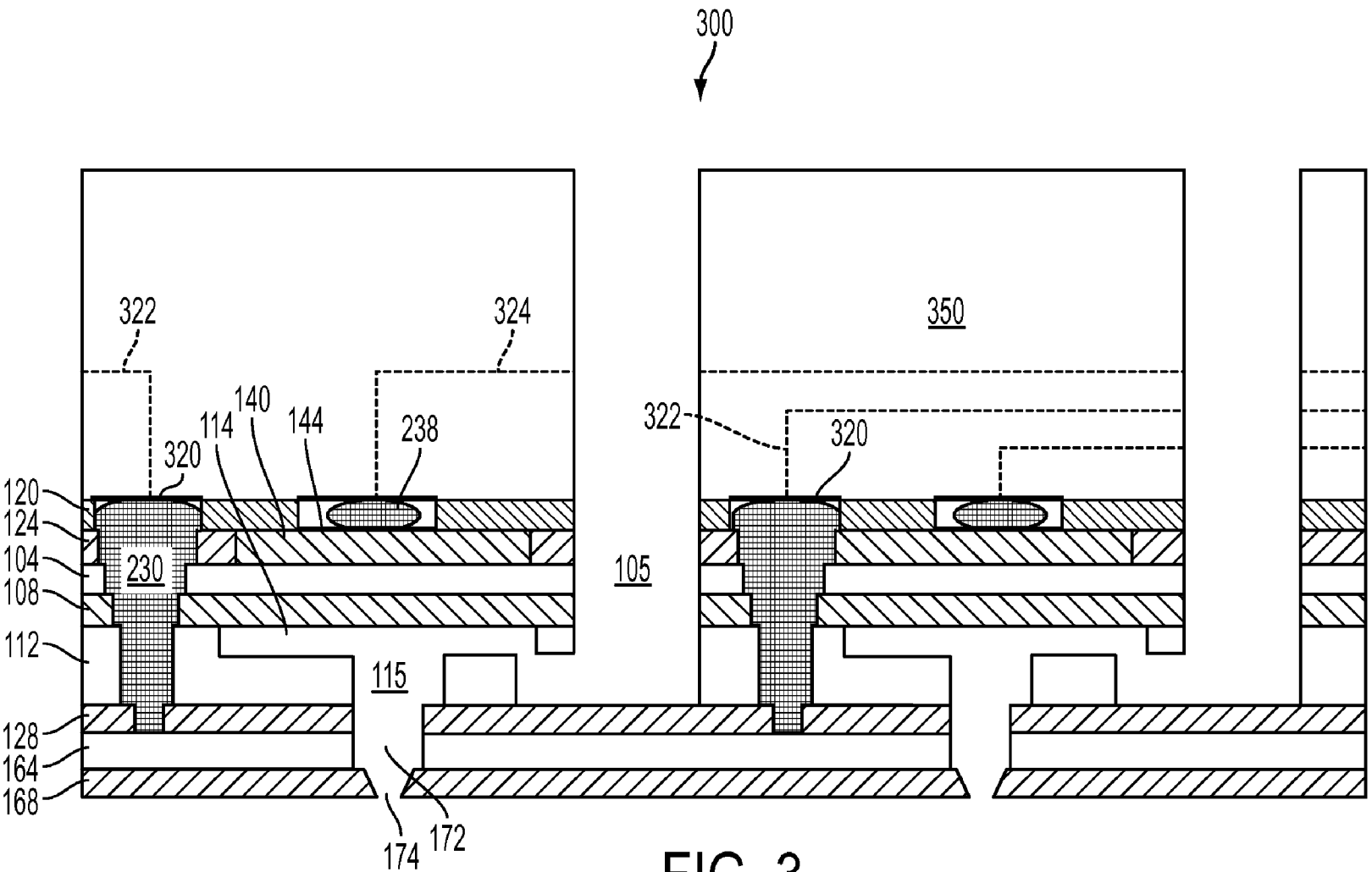
FIG. 3 is a cross sectional view of a print head after the stenciling process of FIG. 2 is completed and an electrical circuit board (ECB) is affixed to the print head stack.
Figure 4A:
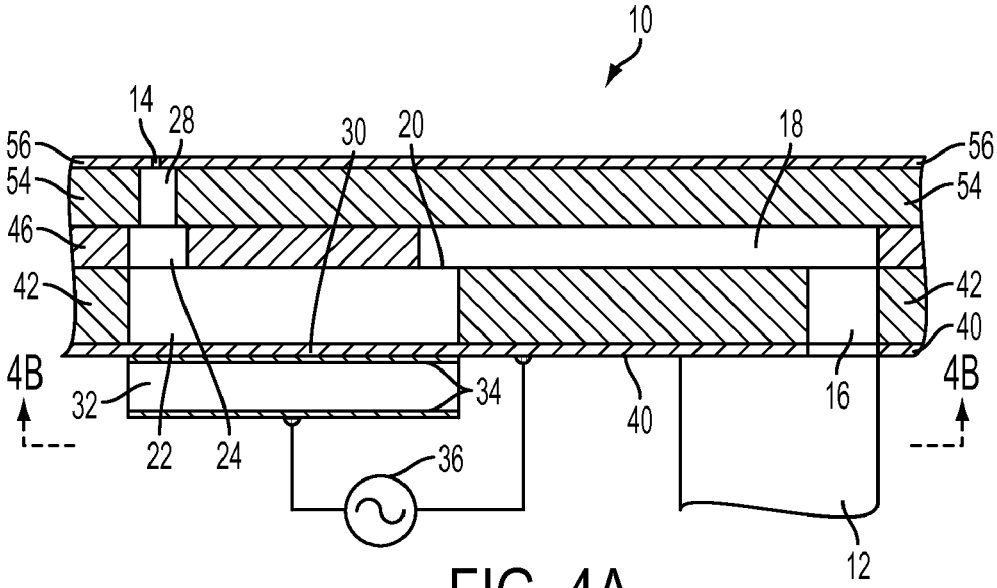
FIG. 4A PRIOR ART
FIG. 4A is a schematic side-cross-sectional view of a prior art embodiment of an inkjet.
Figure 4B:
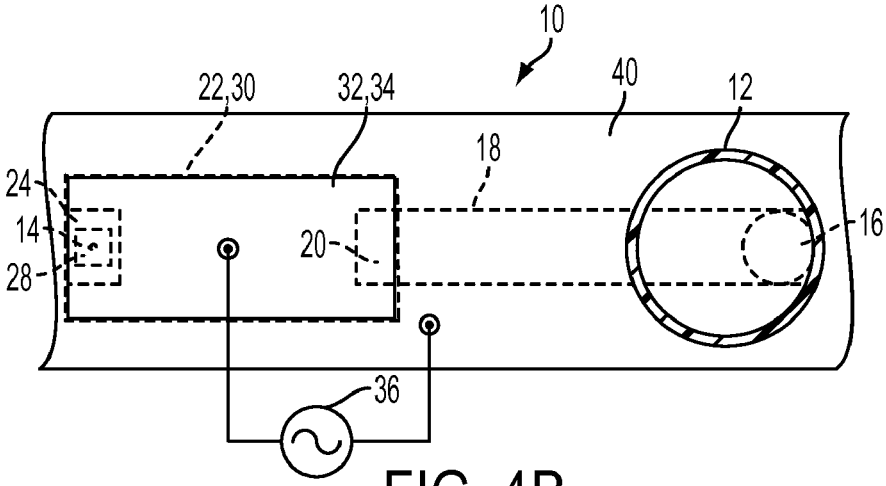
FIG. 4B PRIOR ART
FIG. 4B is a schematic view of the prior art embodiment of the inkjet of FIG. 4A.

FIG. 3 depicts a print head 300 after the stenciling process of FIG. 2 is completed and an electrical circuit board (ECB) or flexible circuit 350 is affixed to the print head stack. The ECB's base contains an electrical ground conductor 322 and an electrode 320 that provide an electrical path to electrical ground. The conductor 322 and the electrode 320 are typically formed from a sheet of exposed copper metal in the circuit board. Connecting the electrical ground to the conductive adhesive mass 230 electrically couples electrical ground to the diaphragm layer 104. Thus, metal diaphragm layer 104 becomes an electrical grounding plane. Consequently, the second electrically conductive adhesive mass in the second pass-through via shown in FIG. 3 is redundant as the diaphragm layer at the second conductive mass is electrically coupled to electrical ground through the first pass-through via. Not all inkjet ejectors have a pass-through via associated with them for this reason, but a number of pass-through vias are provided and filled with electrical conductive adhesive to provide redundancy for the electrical grounding function in a print head. Because the electrically conductive adhesive electrically couples the aperture brace plate 164, and the body layer 112 to the diaphragm layer 104, they are also electrically coupled to a common electrical ground.

In operation, ink flows through an ink inlet 105 and into the pressure chamber 114. An electrical firing signal passes over conductive trace 324, through conductive adhesive 238, and electrode 144 to transducer 140. A thermal transducer may heat the diaphragm 104 and thermoplastic polyimide layer 108, causing a bubble to form in the pressure chamber 114, urging ink into outlet port 115. Alternatively, a piezoelectric transducer may bend, causing the diaphragm layer 104 to deform, also urging ink into the outlet port 115. The ink then travels through outlet channel 172 and is expelled from the print head as a droplet via nozzle 174. During operation, any static electrical charges accumulated in any metal layer of the print head are dissipated by the electrical coupling of the electrically conductive layers, such as the aperture brace plate 164, body layer 112, or diaphragm 104, through the electrically conductive adhesive mass 230 and conductor 322 to electrical ground.

The various electrically conductive paths used to couple the transducers with the firing signal circuits and the electrically conductive layers with electric ground depicted in FIG. 2 and FIG. 3 do not exclude other possible configurations. Instead, they are merely illustrative of some of the envisioned embodiments that couple transducers to firing circuits and electrically isolated conductive layers to electrical ground. For example, each conductive layer in the print head stack may have its upper surface exposed through a channel independent of other channels exposing other conductive layers. In another arrangement, a pass-through via may be formed that enables a lower electrically conductive layer to be coupled electrically to the diaphragm plate and another pass-through via may be formed that electrically couples the diaphragm plate to an electrical conductor electrically coupled to electrical ground.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An inkjet ejector comprising:

a diaphragm plate have a first side and a second side;

a plurality of transducers mounted to the first side of the diaphragm plate;

a polymer layer located on the second side of the diaphragm plate;

an electrically conductive layer that is isolated from electrical ground by the polymer layer; and a plurality of electrical conductors, at least one of the electrical conductors extends from the electrically conductive layer to electrical ground through the polymer layer and other electrical conductors of the plurality of electrical conductors extend from each transducer to a firing signal circuit, the electrical conductor extending from the electrically conductive layer being the same material as the other electrical conductors in the plurality of electrical conductors.

2. The inkjet ejector of claim 1 wherein the electrically conductive layer is metal.

3. The inkjet ejector of claim 1, the electrical conductor extending from the electrically conductive layer to electrical ground further comprising:

a first electrical conductor extending from the diaphragm plate to the electrical ground; and a second electrical conductor extending from the electrically conductive layer to the diaphragm plate through an opening in the polymer layer.

4. The inkjet ejector of claim 1 wherein the transducers are piezoelectric transducers.

5. The inkjet ejector of claim 1, wherein the electrically conductive layer is a body layer having a pressure chamber, the polymer layer electrically isolates the body layer from the diaphragm layer, and the at least one electrical conductor electrically couples the diaphragm layer to electrical ground; and the inkjet ejector further comprising:

a polymer outlet layer having an outlet that fluidly communicates with the pressure chamber in the body layer to enable ink from the pressure chamber to pass through the outlet layer;

an aperture layer that is electrically conductive and configured with an aperture that fluidly communicates with the outlet of the outlet layer; and a second electrical conductor that extends through the polymer outlet layer, the body layer, and the polymer layer that electrically isolates the body layer from the diaphragm layer to electrically couple the aperture layer to the diaphragm layer, the second electrical conductor being the same material as the other electrical conductors in the plurality of electrical conductors.

6. The inkjet ejector of claim 5 further comprising:

an opening that extends through the second polymer layer that enables the electrical conductor to electrically couple the aperture layer to the diaphragm layer, the opening being narrower at the aperture layer than the opening is at the outlet layer.

7. The inkjet ejector of claim 1 wherein the material of the electrical conductors is a conductive adhesive.

8. The inkjet ejector of claim 1 wherein the conductive adhesive is a silver-filled epoxy.

* * * * *